United States Patent [19]

Broadhurst

[11] Patent Number: 4,728,413

[45] Date of Patent: Mar. 1, 1988

[54] AGITATED DEWAXING EMPLOYING MODIFIED AGITATOR MEANS

[75] Inventor: Thomas E. Broadhurst, Sarnia, Canada

[73] Assignee: Exxon Research and Engineering Company, Florham Park, N.J.

[21] Appl. No.: 865,426

[22] Filed: May 21, 1986

Related U.S. Application Data

[63] Continuation of Ser. No. 653,202, Sep. 24, 1984, abandoned.

[51] Int. Cl.[4] ..... C10G 43/08

[52] U.S. Cl. ..... 208/33; 196/14.5

[58] Field of Search ..... 208/33, 35, 37, 38; 196/14 S

[56] References Cited

U.S. PATENT DOCUMENTS

| | | | |
|---|---|---|---|
| 2,302,428 | 11/1942 | Pons et al. | 196/14.5 |
| 3,192,125 | 6/1985 | Sparks et al. | 208/35 |
| 3,644,195 | 2/1972 | Gudelis et al. | 208/33 |
| 3,681,230 | 8/1972 | Eagen et al. | 208/33 |
| 3,773,650 | 11/1973 | Hislop et al. | 208/38 X |
| 4,111,790 | 9/1978 | West | 208/33 |
| 4,140,620 | 2/1979 | Pavlett | 208/33 |
| 4,334,978 | 6/1982 | Broadhurst | 208/33 |
| 4,441,987 | 4/1984 | Broadhurst | 208/33 |

*Primary Examiner*—Helen M. S. Sneed

*Assistant Examiner*—Glenn Caldarola

*Attorney, Agent, or Firm*—Joseph J. Allocca

[57] ABSTRACT

The filtration performance of a slurry containing crystallized wax, dewaxed oil and dewaxing solvent is improved by use of an agitator means which possesses a characteristic dimension which when divided by the average wax crystal diameter yields a dimensionless number of about 1,500 or less, preferably about 1,000 or less, more preferably about 500 or less, most preferably about 250 or less. Use of an agitator means which possesses a characteristic dimension yielding a dimensionless number in the range recited above causes a reduction in the size of the vortex generated as the agitator means passes through the slurry during chilling. As a consequence, more intimate contacting of the wax particles during chilling is promoted.

The needed characteristic dimension of the agitator may be obtained in any number of equally acceptable ways. Single large agitator blades can be replaced by more numerous smaller blades; large blades can be perforated, notched, etc.

Any alteration which causes the agitator characteristic dimension to be reduced so that when it is divided by the average cyrstal wax size the resulting dimensionless number is about 1,500 or less in an acceptable modification.

15 Claims, No Drawings

AGITATED DEWAXING EMPLOYING MODIFIED AGITATOR MEANS

This is continuation of application Ser. No. 653,202, filed 9/24/84, now abandoned.

DESCRIPTION OF THE INVENTION

The filtration performance of a wax/oil slurry, preferably a slurry of wax/oil/dewaxing solvent, is improved by employing agitator means during the chilling step which exhibit a dimensionless number of about 1,500 or less, preferably about 1,000 or less, more preferably about 500 or less, most preferably about 250 or less, the dimensionless number being determined by dividing the characteristic dimension of the agitator means by the average wax crystal particle size diameter. By insuring that the dimensionless number is in the range recited above, the size of the vortex generated as the agitator means passes through the slurry is reduced. As a consequence more intimate contacting of the wax particles during chilling is promoted and this, in turn, results in producing a wax/oil/solvent slurry exhibiting improved filter rate.

The characteristic dimension of the agitator means can be set or adjusted using any number of equally acceptable techniques. Thus, large agitator blades (exhibiting large characteristic dimension) can be replaced by more numerous smaller blades. Similarly, the large agitator blades can be perforated and/or the edges of the blades notched so as to reduce the effective characteristic dimension of said blade, or the blades can be made of wire mesh.

The agitator means which passes through the slurry of wax/oil/dewaxing solvent during chilling is characterized by possessing finite dimensions of width and height perpendicular to the direction of agitator means motion. The direction of agitator means motion is usually rotational about a central axis.

Agitator means, described for the sake of simplicity in the balance of this specification as a paddle blade, exhibits a broad frontal area to the slurry as it passes through the slurry. Passage of the paddle blade through the slurry produces a vortex in the slurry. The size of the vortex influences the degree of contacting which is achieved between the wax particles which crystallize in the slurry in the course of chilling.

The vortex size can be influenced by changes in the dimensions of the paddle blade. The controlling dimension is taken to be the largest continuous dimension across the paddle cross section. This is frequently the height of the paddle blade. By height is meant the dimension of the paddle blade, which is perpendicular to the direction of paddle blade motion which is usually rotation about a central axis, or expressed differently, which is parallel to the axis of rotation when a rotating agitation means is employed.

As previously stated, this characteristic dimension can be reduced by using smaller blades, or wire mesh blades, or by perforating the paddle blades, or by notching the edges of the paddle blades. These holes or notches, or smaller blades, etc., produce openings which reduce the characteristic dimension of the paddle blade. For the purposes of this specification, characteristic dimension is taken to be the length of the unbroken distance between the holes, openings, notches, etc. on the blade, or, the unbroken distance between the holes, openings, notches, etc. and an edge of the paddle blade, which ever distance is greater and predominates. To this end, it is preferred that sufficient holes, rectangular openings, notches, or smaller blades be employed and spaced so as to significantly effect the characteristic dimension of the blades. In the example herein holes occupied about 50% of the surface area of the blade. These holes were evenly distributed across the surface of the blade and were in an even configuration horizontally and vertically, but a staggered configuration could just as easily have been employed. In the example the characteristic dimension was taken to be the distance between the perforations in the blade which was 0.1 cm.

Wax crystal size can easily be measured by means of, for example, a Coulter counter. The mean diameter of the wax crystals resulting from a high agitation chilling procedure is generally between about 35–70 microns, average about 50 microns. In the DILCHILL dewaxing process, described in detail in U.S. Pat. No. 3,773,580, the was crystal mean diameter is about 35–70 microns, more usually about 50 microns.

Any waxy hydrocarbon oil, petroleum oil, preferably lube oil or other distillate fraction, may be dewaxed by the process of this invention. In general, these waxy oil stocks will have a boiling range within the broad range of about 500° F. to about 1,300° F. The preferred oil stocks are the lubricating oil and specialty oil fractions boiling within the range of about 500° F. and 1,200° F. These fractions may come from any source, such as the paraffinic crudes obtained from Saudi Arabia, Kuwait, the Panhandle, North Louisiana, Western Canada, Tia Juana, etc. The hydrocarbon oil stock may also be obtained from a synthetic crude source, such as from coal liquefaction, synfuel, tar sands extraction, shale oil recovery, etc.

In the process of the present invention it is preferred that the waxy oil be chilled in the presence of a dewaxing solvent. This solvent can be selected from any of the known, readily available dewaxing solvents. Representative examples of such solvents are the aliphatic ketones having from 3 to 6 carbons, such as acetone, methyl ethyl ketone (MEK), methyl isobutyl ketone (MIBK), and mixtures thereof, e.g., MEK/MIBK; aromatic hydrocarbons having from 6 to 10 carbons; mixtures of aliphatic ketones with aromatic hydrocarbons, such as MEK/toluene, halogenated low molecular weight hydrocarbons, such as $C_2$ to $C_4$ chlorinated hydrocarbons, e.g., dichloromethane, dichloroethane, etc., and mixtures thereof. Ethers can also be employed as solvents, the preferred ether being methyl tertiary butyl ether, preferably used in combination with MEK. Autorefrigerative solvents, such as propane, propylene, butane, butylene and mixtures thereof, as well as mixtures of autorefrigerative solvents with other normally liquid solvents, e.g., propylene, acetone, mixtures, may also be employed.

The waxy oil and dewaxing solvent may be contacted under any number of typical agitated dewaxing process conditions, e.g., incremental dilution, dilution chilling, etc. The preferred solvent dewaxing process, however, is the DILCHILL® (DILCHILL is a registered service mark of Exxon Research and Engineering Company) dewaxing process.

The DILCHILL process was developed so as to overcome the inherent limitations and disadvantages of scraped surface chilling dewaxing. In the DILCHILL process cooling is accomplished in a staged chilling vessel, such as a tower. The waxy oil is moved through the tower while cold solvent is injected along the tower directly into a plurality of the stages (either some or all of the stages have cold solvent directly injected into them). The cold solvent injection is accompanied by the maintaining of a high degree of agitation in at least a portion of the stages containing waxy oil and the injected cold solvent so as to insure substantially instantaneous mixing of the cold solvent and waxy oil to avoid shock chilling. This high degree of agitation is accomplished by use of agitation means, such as paddle blades mounted on a rotating shaft axis. Chilling is conducted to a temperature of between about 0° F. and 50° F. A substantial portion of the wax is precipitated from the waxy oil under these conditions of said solvent injection and high agitation. The DILCHILL process is described in greater detail in U.S. Pat. No. 3,773,650, hereby incorporated by reference.

In a modified DILCHILL process, cooling by means of cold solvent injection and high agitation is conducted to a temperature greater than the temperature at which the wax is separated from the oil, i.e., the wax separation temperature, but generally less than about 40° F. above said separation temperature and preferably less than about 35° F. above said separation temperature, thereby precipitating at least a portion of the wax from the waxy oil. This oil/solvent/wax slurry is then withdrawn from the DILCHILL chilling zone and introduced into a second chilling zone wherein it is cooled to the wax separation temperature, thereby precipitating a further portion of the wax from the waxy oil. The modified DILCHILL process employing scraped surface chillers in the second chilling zone is described in detail in U.S. Pat. No. 3,775,288, while a modified DILCHILL process employing a high speed agitation in an indirect chilling zone is described in detail in U.S. Pat. No. 4,441,987. While the present invention is applicable and will be of benefit in any chilling process employing agitated chilling means, an agitated chilling process which employs no scraped surface chillers is preferred since scrapers physically crush the wax crystals formed on the scraped surface chiller wall thereby reducing wax filtration rates and increasing the amounts of occluded oil in the wax. Consequently, the modified agitation means of the present invention are most advantageously employed in a straight DILCHILL process.

It has been discovered that the filterability of the slurry of wax/oil/solvent resulting from a dewaxing process is improved when the dimensionless number resulting when the characteristic dimension is divided by the wax crystal mean diameter is about 1,500 or less, preferably about 1,000 or less, more preferably about 500 or less, most preferably about 250 or less.

To appreciate the filtration rate improvement which is obtained by employing the relationship described above, reference is made to the following Examples.

EXAMPLE

In the plant the dimensionless number resulting from dividing the characteristic dimension of the paddle blade by the mean diameter of the wax crystal particle has been determined to be between 2,000 and 4,000. In the pilot plant the dimensionless number has been determined to be between 200 and 400. Modifications were made to the pilot plant paddle blade, i.e., perforations have been made, so that the characteristic dimension has been substantially reduced, resulting in a reduction in the dimensionless number to levels of about 50 or less. The pilot plant was a 17 stage vessel. Chilling was accomplished using a 40/60 mixture of MEK/MIBK chilled to −20.0° F. Impeller diameter in the pilot plant was 3 inches. Impeller tip speed was 500 ft/min at 636.6 RPM. The feed was not prediluted.

TABLE A

| | Pilot Plant Operating Conditions | | | |
|---|---|---|---|---|
| Oil | Feed Temp °F. | Outlet Temp. °F. | Chilling Rate °F. | Total Dilution |
| MCT-30 | 135 | 25.8 | 3.17/min | 3.2 |
| 100N | 102 | 25.6 | 2.94/min | 2.2 |
| SL150N | 104 | 22.0 | 3.16/min | 2.3 |
| Barosa-56 | 135 | 19.4 | 3.4/min | 3.5 |
| HSN | 142 | 14.6 | 3.86/min | 4.0 |
| NL1509N | 107 | 22.0 | 3.10/min | 2.9 |

The filtration rates on similar feeds employing these different units are presented below.

TABLE I

PERFORMANCE OF DIFFERENT FEEDS AT VARYING VALUES OF THE DIMENSIONLESS NUMBER "D"

$$D = \frac{\text{Characteristic Impeller Dimension*}}{\text{Average Wax Crystal Size}}$$

| | Plant | Pilot Plant | Perforated Impellers in Pilot Plant (Rounded Out) | Perforated Impeller in Pilot Plant / Standard Impeller |
|---|---|---|---|---|
| Values of "D" | | | | |
| 100N | 2111 | 208 | 14 | |
| SL150N | 2815 | 278 | 19 | |
| Barosa 56 | 2764 | 273 | 19 | |
| Heavy Neutral | 4108 | 405 | 27 | |
| NL150N | 3407 | 223 | — | |
| MCT-30 | — | 267 | 18 | |
| Feed Filter Rate ($m^3/m^2$ day) | | | | |
| 100N | 10.67 | 11.96 | 12.72 | +6.3% |
| SL150N | 6.15 | 10.87 | 11.83 | +8.9% |
| Barosa 56 | 4.59 | 5.97 | 6.68 | +11.9% |
| Heavy Neutral | 2.96 | 4.46 | 4.53 | +1.5% |
| NL150N | 10.25 | 12.28 | — | — |
| MCT-30 | — | 5.73 | 6.24 | +8.9% |
| Liquids/Solids (w/w) | | | | |
| 100N | 5.20 | 4.40 | 4.25 | −3.4% |
| SL150N | 8.73 | 5.66 | 5.24 | −7.4% |

TABLE I-continued

PERFORMANCE OF DIFFERENT FEEDS AT VARYING VALUES OF THE DIMENSIONLESS NUMBER "D"

$$D = \frac{\text{Characteristic Impeller Dimension*}}{\text{Average Wax Crystal Size}}$$

| | Plant | Pilot Plant | Perforated Impellers in Pilot Plant (Rounded Out) | Perforated Impeller in Pilot Plant / Standard Impeller |
|---|---|---|---|---|
| Barosa 56 | 4.14 | 4.18 | 4.15 | −0.7% |
| Heavy Neutral | 7.11 | 6.37 | 6.20 | −2.6% |
| NL150N | 4.42 | 3.72 | — | — |
| MCT-30 | — | 4.91 | 4.95 | +0.8% |
| DWO Yield (%) | | | | |
| 100N | 72.6 | 74.8 | | |
| SL150N | 85.9 | 88.5 | | |
| NL150N | 77.8 | 78.8 | | |
| Barosa 56 | 76.6 | 76.7 | | |
| HSN | 87.2 | 87.5 | | |

*The characteristic impeller dimension used in these calculations was the blade height, in the plant (15.2 cm) and in the pilot plant (1.5 cm). The size of the hole perforations in the case of the perforated impellers was 0.18 cm. The holes occupied 50% of the surface area of the paddle blade and were evenly distributed across the surface of the paddle blade in an even configuration. A staggered configuration could just as easily have been employed. The characteristic dimension of the perforated impeller was the distance between holes, in this case 0.1 cm.

The mean wax crystal size as measured by the Coulter Counter was:

| | |
|---|---|
| 100N | .0072 cm |
| SL150N | .0054 cm |
| Barosa 56 | .0055 cm |
| Heavy Neutral | .0037 cm |
| MCT-30 | .0056 cm |

What is claimed is:

1. A method for improving the filtration performance of a wax/oil slurry resulting from dewaxing waxy hydrocarbon oil under agitated conditions in a dewaxing plant which method comprises using an agitator means during the formation of the wax/oil slurry which agitator means possesses openings in the frontal area presented to the slurry during agitation which openings reduce the characteristic dimension of said agitator means so that the dimensionless number which results when the characteristic dimension of the agitator means is divided by the average wax crystal particle size is about 1500 or less.

2. The method of claim 1 wherein the dimensionless number which results when the characteristic dimension of the agitator means is divided by the average wax particle size is about 1,000 or less.

3. The method of claim 2 wherein the dimensionless number which results when the characteristic dimension of the agitator means is divided by the average wax particle size is about 500 or less.

4. The method of claim 3 wherein the dimensionless number which results when the characteristic dimension of the agitator means is divided by the average wax particle size is about 250 or less.

5. The method of claim 1, 2, 3 or 4 wherein the openings of the agitator means are produced by introducing perforations into the agitator means.

6. The method of claim 1, 2, 3 or 4 wherein the openings of the agitator means are produced by introducing irregular shapes or notches on the edges of the agitator means.

7. The method of claim 1, 2, 3, or 4 wherein the slurry comprises wax, oil and a dewaxing solvent.

8. The method of claim 5 wherein the slurry comprises wax, oil and a dewaxing solvent.

9. The method of claim 6 wherein the slurry comprises wax, oil and a dewaxing solvent.

10. The method of claim 7 wherein the dewaxing solvent is selected from $C_3$ to $C_6$ ketones, $C_6$ to $C_{10}$ aromatic hydrocarbons, mixtures of $C_3$ to $C_6$ ketones, and $C_6$ to $C_{10}$ aromatic hydrocarbons, $C_2$ to $C_3$ halogenated hydrocarbons, ethers.

11. The method of claim 8 wherein the dewaxing solvent is selected from $C_3$ to $C_6$ ketones, $C_6$ to $C_{10}$ aromatic hydrocarbons, mixtures of $C_3$ to $C_6$ ketones, and $C_6$ to $C_{10}$ aromatic hydrocarbons, $C_2$ to $C_3$ halogenated hydrocarbon, ethers.

12. The method of claim 9 wherein the dewaxing solvent is selected from $C_3$ to $C_6$ ketones, $C_6$ to $C_{10}$ aromatic hydrocarbons, mixtures of $C_3$ to $C_6$ ketones, and $C_6$ to $C_{10}$ aromatic hydrocarbons, $C_2$ to $C_3$ halogenated hydrocarbon, ethers.

13. The method of claim 10 wherein the dewaxing solvent is methyl ethyl ketone, methylisobutyl ketone, mixtures of methyl ethyl ketone and methyl isobutylketone, and mixtures of methyl ethyl ketone and toluene.

14. The method of claim 11 wherein the dewaxing solvent is methyl ethyl ketone, methyl isobutyl ketone, mixtures of methyl ethyl ketone and methyl isobutyl ketone and mixtures of methyl ethyl ketone and toluene.

15. The method of claim 12 wherein the dewaxing solvent is methyl ethyl ketone, methyl isobutyl ketone, mixtures of methyl ethy ketone and methyl isobutyl ketone and mixtures of methyl ethyl ketone and toluene.

* * * * *